US008623201B2

(12) United States Patent
Hui

(10) Patent No.: US 8,623,201 B2
(45) Date of Patent: Jan. 7, 2014

(54) POOL CLEANING VEHICLE HAVING IMPROVED LOGIC

(75) Inventor: Wing-kin Hui, Hong Kong (HK)

(73) Assignee: Smartpool LLC, Lakewood, NJ (US)

( * ) Notice: Subject to any disclaimer, the term of this patent is extended or adjusted under 35 U.S.C. 154(b) by 614 days.

(21) Appl. No.: 12/551,098

(22) Filed: Aug. 31, 2009

(65) Prior Publication Data

US 2011/0049023 A1 Mar. 3, 2011

(51) Int. Cl.
*E04H 4/16* (2006.01)

(52) U.S. Cl.
CPC ..... *E04H 4/1654* (2013.01)
USPC ..... 210/91; 210/141; 210/143; 210/167.16

(58) Field of Classification Search
CPC ..... E04H 4/1654
USPC ..... 210/167.16, 416.2, 141, 91, 143; 15/1.7; 134/56 R
See application file for complete search history.

(56) References Cited

U.S. PATENT DOCUMENTS 6,099,658 A * 8/2000 Porat ..... 134/18
7,900,308 B2 * 3/2011 Erlich et al. ..... 15/1.7

* cited by examiner

*Primary Examiner* — Terry Cecil
(74) *Attorney, Agent, or Firm* — Birch, Stewart, Kolasch & Birch, LLP

(57) ABSTRACT

A swimming pool cleaning vehicle including a housing having a body shell, a frame, and an interior with the housing. The housing having an outlet for releasing air from the shell. The shell being removably attached to the frame, and the frame including a base. The vehicle including a filtration system having a pump motor for pumping pool water through a filtration system, the pump creating a suction force, and the suction force being sufficient to allow the vehicle to climb the pool walls. The vehicle being capable of climbing the pool walls and breaking the surface of the water as it climbs the pool walls. The vehicle including logic for first, initiating vehicle movement, second, shutting off the pump motor, and third, re-starting the pump motor.

16 Claims, 3 Drawing Sheets

POOL CLEANING VEHICLE HAVING IMPROVED LOGIC

CROSS REFERENCE TO RELATED APPLICATIONS

This application relates to three other of the Applicant's filings, which are filed concurrently with this application. Those filings are U.S. application Ser. No. 12/551,211 filed on Aug. 31, 2009; U.S. application Ser. No. 12/100,414 filed on Apr. 10, 2008; and U.S. application Ser. No. 12/551,127 filed Aug. 31, 2009. Additionally, each of those applications is specifically incorporated in full in this application, as if they were word for word written here. They are incorporated in full for all purposes.

FIELD OF THE INVENTION

This invention relates to the field of pool cleaning devices and more particularly to domestic or industrial swimming pool cleaners. More particularly, this invention relates to those pool cleaners that are wall climbing and capable of breaking the surface of the water with their own propulsion.

TECHNICAL BACKGROUND

As noted in earlier patents, notably Porat U.S. Pat. No. 6,099,658, it is increasingly important to clean a pool in the fastest time possible, while doing a thorough job. Efficiency is the most sought after goal in the industry. In the past, pool cleaning vehicles that could climb walls needed to proceed more slowly as they did so, to prevent becoming unstable, especially on the way down.

Porat, above, discloses a vehicle that continues its regular or primary speed on the way up a wall, but then on the return down, slows for a pre-determined period of time, until, hopefully, reaching the pool bottom, and then returning to the primary speed.

It was thought that on way down, in order not to destabilize the vehicle, the slower speed would be required. While, for typical known pool cleaning devices, this may or may not be effective, the net result is to slow down the cleaning of the pool. So ironically, the very thing that Porat is attempting to solve, namely, time efficient cleaning of the pool, is, at least, somewhat adversely affected by the proposed solution.

In Porat's defense, it must be said that the de-stabilization of the device would be more time costly than merely slowing down the device. For example, if the condition known as turtling occurs, namely where the vehicle is stuck upside down, on it's cover as illustrated in FIG. 2 (prior art), clearly this will take more time than merely slowing down the vehicle as it returns down a wall.

As described in FIG. 2, there is shown a pool cleaning device 10 climbing a pool wall 20. As the device 10 breaks the surface of the water 30, air enters the device. As is well known in the art, pool cleaning devices require a near neutral buoyancy in order to effectively go about cleaning the pool. Air entering the device 10 housing 40 can easily de-stabilize the required buoyancy causing the device 10 to fall from the wall, "head over heels" or to turtle. Once the device 10 turtles, it must manually be turned over and re-started.

As noted above, the Porat patent discloses a two speed motor to slow down the device 10 on its return down the wall. The housing of Porat is provided with an air opening which, it is hoped will evacuate enough air once the vehicle begins its return down the wall to prevent destabilization. The combination of the opening, plus the slow speed, are thought by Porat to accomplish its purpose of preventing de-stabilization and thereby more effectively cleaning the pool.

It is also worthy of note that the motor of Porat must be two speed in order to accomplish its disclosed purpose.

As noted above, slowing down the vehicle is in direct contrast to the stated need of cleaning the pool surface as quickly and as effectively as possible. What is needed is a pool cleaning vehicle that includes both structure and logic that minimize the possibility of de-stabilization as well as thoroughly clean the pool surfaces as quickly as possible.

SUMMARY OF THE INVENTION

It is an object of the pool cleaning device in accordance with this invention to provide a cleaning vehicle having logic means for causing the vehicle to move about the surface of the pool, including the upright walls, in a fast and efficient manner for cleaning.

It is an additional object of the pool cleaning device in accordance with this invention to provide a pool cleaning vehicle having on-board logic means for enabling the vehicle to climb a pool wall, shut off a pump within for a very short duration of time, and resume operation of the pump and travel speed.

It is an additional object of the pool cleaning device in accordance with this invention to provide a pool cleaning vehicle, which discourages de-stabilization during the cleaning operation.

It is an additional of object of the pool cleaning device in accordance with this invention to provide a pool cleaning vehicle capable of breaking the surface of the water and capable of releasing air entering the housing without de-stabilizing the vehicle during the cleaning operation.

Consistent with the above stated objects of the invention described above and those that will be understood hereinafter, the swimming pool cleaning device in accordance with this invention, comprises:

a pool cleaning vehicle including a housing;

the housing having:

a body shell and a frame, the shell being removably attached to the frame, the frame including a base and the shell including an outlet;

the vehicle including a filtration system having a pump motor for pumping pool water through filtration system, the pump creating a suction force, the suction force being sufficient to allow the vehicle to climb the pool walls;

the vehicle having being able to climb the pool walls and break the surface of the water;

the vehicle including logic means for first, initiating vehicle movement, second, shutting off pump, and third, re-starting pump;

sensor means for determining the distance between vehicle surface of water, the sensor means in communication with the vehicle logic means; and the logic means causing the pump to operate at a first primary speed, shutting off the pump upon reaching a predetermined distance in relation to the surface of the water, returning the pump to the first primary speed after shut off.

Unlike previously disclosed pool cleaning device, the vehicle consistent with the invention herein, offers the ability to use a pump having a single speed motor. As disclosed with Porat, above, in order to accomplish that disclosed invention a two speed motor is required.

In an exemplary embodiment of the pool cleaning device in accordance with the invention herein, the vehicle is provided with a two speed motor. The motor has a first primary speed, which is used to cleaning the pool surfaces and to even cause the vehicle to break the surface. The motor also has a descent speed, which is a speed in excess of the primary speed, causing the vehicle to descend at an even greater speed than which it ascended the pool wall during cleaning.

In an exemplary embodiment, the two speed motor embodiment is provided with event driven logic, which senses when the vehicle approaches the target distance from the pool water surface. As used herein, the target distance may cause the vehicle to actually break the surface of the water.

In another exemplary embodiment, the logic associated with the vehicle is time and event driven. It can be statistically predicted that given a certain size pool having a known height for the walls, how long a period of time, it will take for the vehicle going a known rate of speed to climb the walls. Thus, the target distance, at which point the pump shuts off, can be predicted with reasonable accuracy using a timing scheme. In that embodiment, the vehicle logic includes a timing device.

In yet another exemplary embodiment in accordance with the vehicle of the invention, the logic means is a combination of event and timing logic.

In order to prevent turtling or de-stabilization, the vehicle has a low center of gravity in an exemplary embodiment.

An exemplary embodiment of the logic means for the vehicle, comprises the steps of:

initiating the vehicle drive means for movement along the surface of the pool;

moving the vehicle until contact with the wall is sensed by a sensor;

timing vehicle movement, if no wall is sensed within a first predetermined period of time, vehicle direction is reversed;

upon sensing a wall, timing the movement for a second predetermined period of time;

after reaching the second predetermined period of time, shutting off the drive means for a third predetermined period of time;

after reaching the third pre-determined time for shut off, re-starting the motor; and repeating the above pattern.

In an exemplary embodiment, the first predetermined period of time is between 30 and 120 seconds. The second predetermined period is between 3 and 20 seconds. And, the predetermined period of time for shut off is between 0.2 and 5 seconds.

It is an advantage of the pool cleaning vehicle in accordance with this invention to provide a vehicle for cleaning pools which does so in a more efficient manner than prior such devices.

It is also an advantage to provide such a cleaning vehicle, which provides for improved efficiency in cleaning, while having a single speed motor.

DETAILED DESCRIPTION OF THE INVENTION

Figure 1:
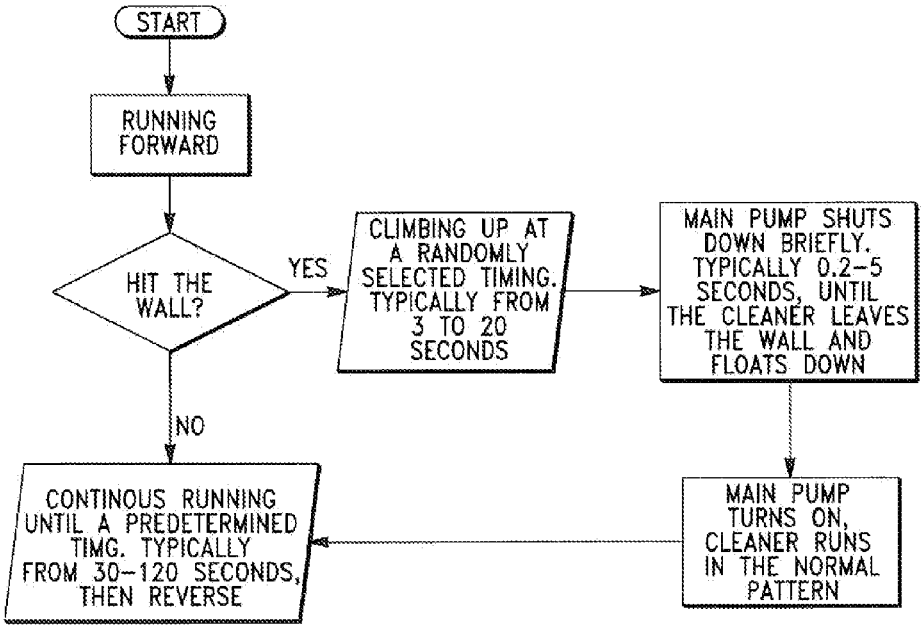
FIG. 1 illustrates an exemplary embodiment of the logic used by the pool cleaning vehicle in accordance with this invention.

To better illustrate the objects and advantages of the pool cleaning vehicle in accordance this invention, a detailed description of the drawing is provided below. As will be appreciated by those skilled in the art, the exemplary embodiments are provided for explanation only and are not to be for purposes of limiting the scope of the invention.

FIG. 1 illustrates a schematic of the logic (vehicle control means), which forms an integral part of the structure of the pool cleaning vehicle in accordance this invention.

Figure 2:
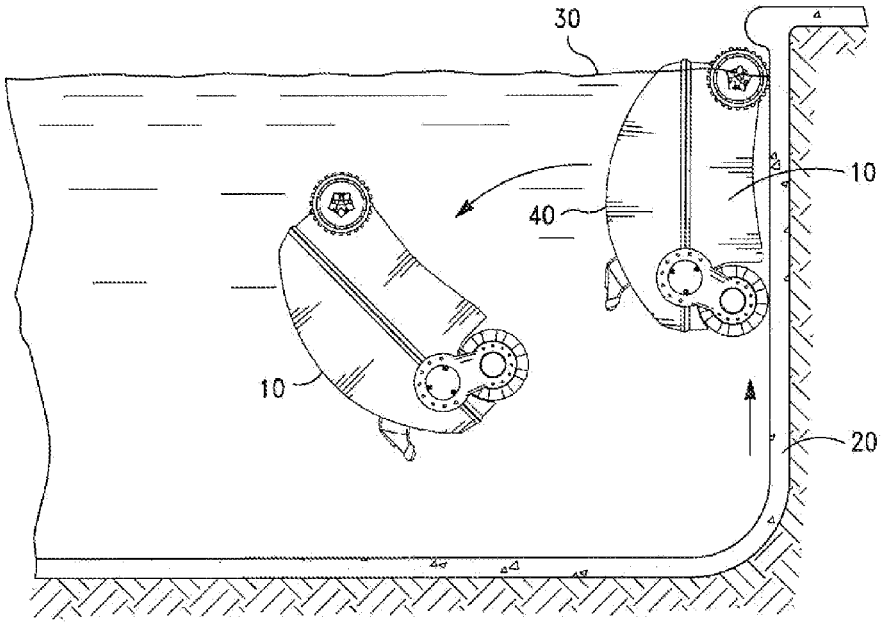
FIG. 2 (PRIOR ART)
FIG. 2. illustrates a typical prior art pool cleaning device of the kind described in the Background above.

FIG. 2 has been previously described and as noted above illustrates a typical prior art device reaching and even breaking the surface of the pool water. Thereafter, as illustrated, the pool cleaning device becomes de-stabilized. In this case, the de-stabilization causes the device to turtle, rolling over on its back. In the turtle position, the user must make manual correction. Quite clearly, the normal operation of cleaning the pool is interrupted, delayed and intervention by the user prevents automation of the operation. Additionally, unless the device has shut-off safeguards, the turtling can result in motor burnout and device replacement.

Figure 3:
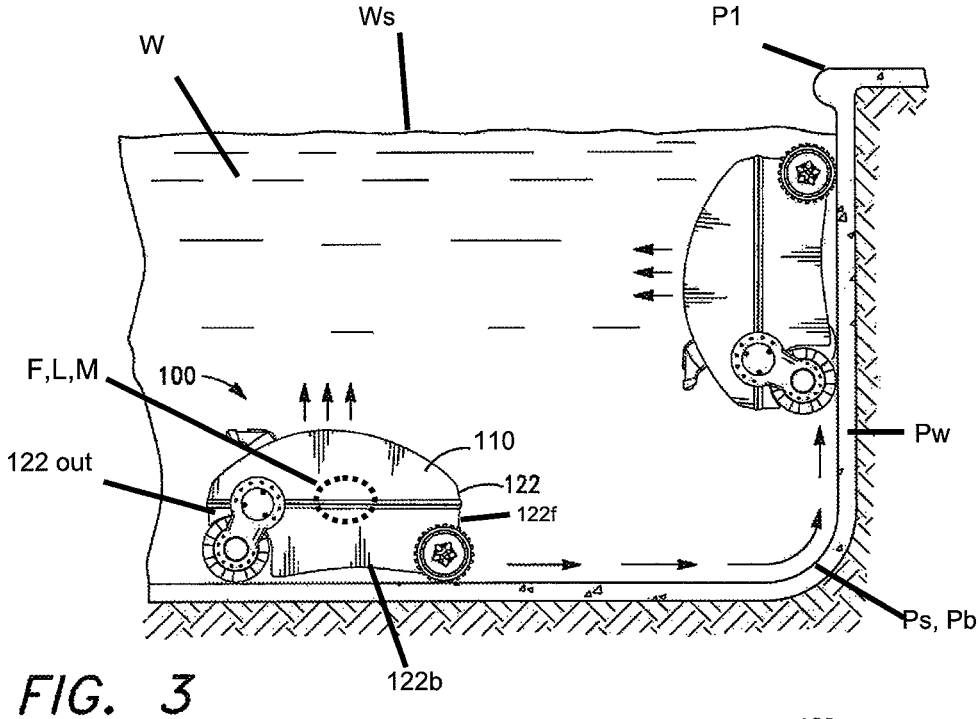
FIG. 3. illustrates an exemplary embodiment of the pool cleaning vehicle in accordance with this invention going about its normal cleaning operation.
Figure 4:
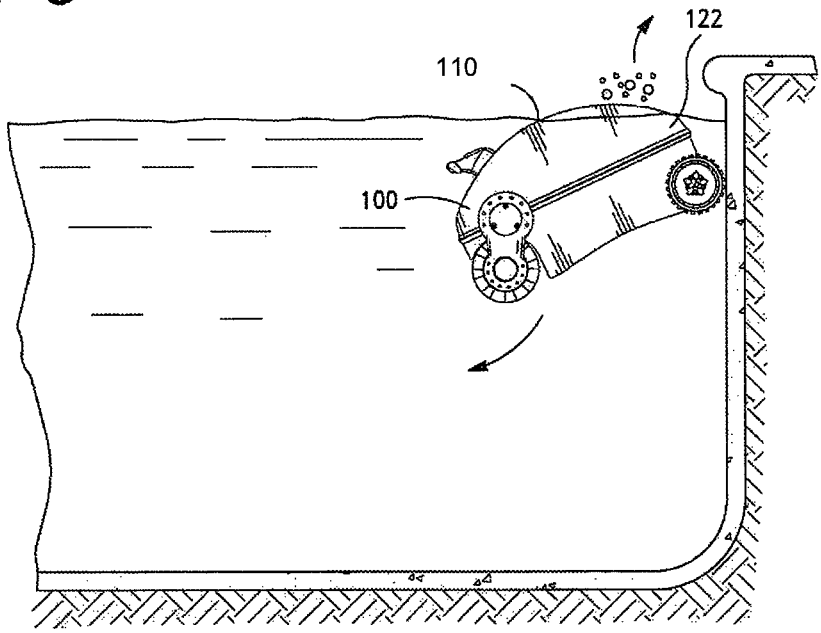
FIG. 4. illustrates the exemplary embodiment of the pool cleaning vehicle in accordance with this invention breaking the surface of the water.
Figure 5:
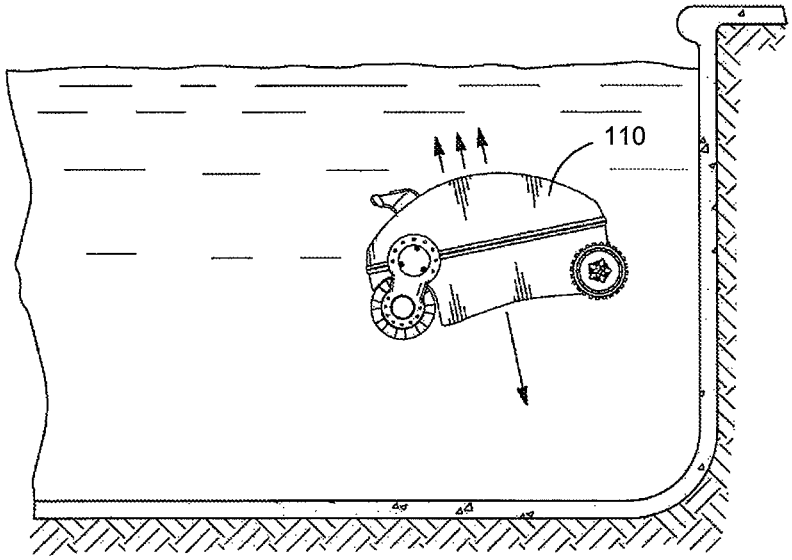
FIG. 5 illustrates another exemplary embodiment of the pool cleaning device in accordance with this invention entering free fall.

FIG. 3 illustrates the normal operation of the pool cleaning vehicle in accordance this invention. The vehicle includes a drive means (not illustrated) for moving the vehicle about the surface of the pool. The vehicle further includes a filtration system having a pump motor M for pumping pool water W through the vehicle filtration system F. The pump creates a suction force sufficient to allow the vehicle to climb the pool walls Pw. In an exemplary embodiment, the motor for the drive means and the pump motor M are one and the same.

The pool cleaning vehicle 100 includes a housing 110 having a body shell 122 and a frame 122*f*. The shell 122 is removably attached to the frame 122*f*. The frame includes a base 122*b*. The shell 122 includes a water outlet 122 out for removing water from the housing 110.

In an exemplary embodiment, the vehicle 100 has a combination of event and timing logic. As illustrated in FIG. 1 and FIGS. 3-5, the logic L (vehicle control means) includes a command to start the vehicle 100. Upon starting, the vehicle 100 moves forward. As illustrated particularly in FIG. 3, the vehicle moves forward until encountering a wall Pw.

The vehicle 100 includes a sensor, for example a mercury switch, which conveys information that the vehicle has, in fact, encountered, a wall Pw. The vehicle 100 also includes timing means. So, for example, if the vehicle 100 travels forward for a predetermined time without the sensor Ms. sensing the wall W, the vehicle is sent a signal to stop and reverse direction.

In an exemplary embodiment, the predetermined time for traveling in a first direction is typically set between 30 and 120 seconds. The time delay is set depending upon the length and width of the pool P1 as well as the running speed of the pool cleaner.

Typically, the vehicle 100 will reach the wall Pw before timing out and reversing direction. Once the vehicle 100 reaches the wall 100, the sensor will sense the climbing motion and begin another timer phase. In the climbing timer phase, the vehicle 100 will climb a predetermined time.

In an exemplary embodiment, the climbing phase is timed differently each time a climb is made. These times are set randomly and encourage the maximum cleaning possible because each pool is constructed differently and each cleaning cycle potentially begins at different locations in a swimming pool. By making the cleaning pattern more random, the entire pool P1 is covered regardless of pool configuration or where the pool cleaner 100 starts its cleaning cycle.

In some of the climbs, the vehicle 100 will break the surface Ws of the water W and allow air into the housing 110. Thus, the vehicle 100 needs to have a methodology and structure for releasing the acquired air in the housing 110.

In an exemplary embodiment, the logic L in connection with the vehicle 100 includes a methodology for releasing air from the housing 110 and for keeping the vehicle 100 stable. After the climbing phase has timed out, the pump motor M is shut off and stays off for a predetermined time. In an exemplary embodiment, the pump shut off time is from 0.2 seconds to 5 seconds.

During the pump shut off phase, the vehicle 100 drifts. In typical operation, the vehicle 100 will drift away from the wall Pw while the pump motor M is shut off. Additionally, the vehicle will drift downward toward the bottom of the pool P1.

The rate and amount of drift depends upon the buoyancy of the vehicle 100. Typically, such a vehicle 100 has relatively neutral buoyancy and will drift to the bottom Pb at a relatively slow pace. While it drifts, the pool cleaner 100 may also rotate caused by flotation and gravity, depending upon the vehicle's position orientation at the beginning of the drifting orientation. The pump motor M shuts off, randomly, and changes course after the pool cleaner 100 contacts the side wall Pw or pool bottom Pb. Such methodology provides the pool cleaning vehicle 100 more random running time and therefore a better cleaning pattern.

After reaching the predetermined time out for pump shut off, a signal is sent to the pump motor M to re-start. The pattern described above is repeated until the pool P1 is cleaned based upon the main pool timer.

The logic L of the vehicle 100 may also be event driven. For example, encountering or not encountering a wall Pw is an event. Upon an event taking place, such as either encountering or not countering a wall, breaking the surface Ws of the water W, the motor through the logic herein is directed to another phase.

For example, in an exemplary embodiment, the logic initiates vehicle movement and then upon encountering a wall Pw, activates a sensor Sm, which relays information relative to the distance the vehicle 100 is from the surface Ws of the water W. The sensor Sm in an exemplary embodiment also relays when the vehicle 100 or any part thereof has broken the surface Ws of the water W.

Upon the vehicle being a predetermined distance from the surface Ws of the water W, the vehicle motor M is shut off and the vehicle is allowed to drift away from the water W. Upon the sensor Sm relaying information where the vehicle 100 is in relation to the surface Ws of the water W, the logic re-initiates the motor M and begins to move the vehicle again.

In an exemplary embodiment, the motor M moves the vehicle 100 at the same speed it was previously moving the vehicle. This has the added advantage of a vehicle having only a one speed motor. Of course, in other embodiments, the vehicle may have a two speed motor. The second speed is called hereinafter, the descent speed and is a speed faster than the original travel speed.

It will be appreciated that despite the fact that the above-described embodiment includes a two-speed motor, that such an embodiment is still novel in the art. This is because previous disclosures have all been concerned with such pool cleaning devices, which would easily de-stabilize once air entered the housing. In order to release the air from breaking the surface of the water, it was previously thought that the air needed to be released slowly and therefore the progress of the device was slowed and as a result the rate of descent was slowed. Overall, this was effective because the vehicle did not turtle as shown in FIG. 2, but still the progress of cleaning the pool was slowed because the rate of descent was slowed over the normal travel speed. Additionally, prior disclosures require the pool cleaner with both pump motor and drive motor running to remain at the surface a significant amount of time in order to move sidewise. This methodology further slows down the cleaning process.

In either of the two described embodiments, the normal travel speed of the vehicle 100 is maintained or in the latter embodiment, actually increased. The only concession to the release of air and caution against instability is the motor shut off for a short duration to time.

In order to accomplish the above objects of the invention and to be consistent with the structure of the vehicle 100, the vehicle 100 has a relatively low center of gravity. For example, in prior disclosures, such as U.S. application Ser. No. 12/100,414 having a filing date Apr. 10, 2008, and U.S. application Ser. No. 12/044,931 having a filing date of Mar. 7, 2008, discloses such a vehicle and which are hereby specifically incorporated herein by reference. Thus, as described previously, the motor and even additional ballast may be adjusted to accomplish the principle of using a vehicle 100 having such a low center of gravity.

While the foregoing detailed description has described several embodiments of the cleaning vehicle in accordance with this invention, it is to be understood that the above description is illustrative only and not limiting of the disclosed invention. It will be appreciated there are also various modifications of the intake ports and their location on the cleaning vehicle are suitable for use in the exemplary embodiments discussed above and that there are numerous embodiments that are not mentioned but within the scope and spirit of this invention. Thus, the invention is to be limited only by the claims as set forth below.

What is claimed is:

1. A pool cleaning vehicle having drive means for moving the vehicle about a surface of a pool, comprising:

a housing including:

a body shell and a frame, the shell being removably attached to the frame, the frame including a base and the shell including an outlet;

the vehicle including a filtration system having a pump motor for a pump for pumping pool water through a filtration system, the pump motor creating a suction force, the suction force being sufficient to allow the vehicle to climb pool walls, the pump motor operating drive means;

the vehicle being able to climb the pool walls and to break a surface of the water;

the vehicle including logic means for first, initiating vehicle movement, second, shutting off the pump motor, and third, re-starting the pump motor; and the logic means causing the pump motor to operate at a first primary speed, shutting off the pump motor upon reaching a predetermined distance in relation to the surface of the water, returning the pump motor to the first primary speed after shut off of the pump motor, wherein the vehicle includes sensor means for determining the distance between the vehicle and the surface of water, the sensor means in communication with the logic means of the vehicle.

2. The pool cleaning vehicle as set forth in claim 1, wherein the vehicle has a low center of gravity for discouraging turtling.

3. The pool cleaning vehicle as set forth in claim 1, wherein the drive means and the pump motor comprises a single electrical motor.

4. The pool cleaning vehicle as set forth in claim 3, wherein the motor has a first primary speed and a second faster speed, and wherein the logic means signals the vehicle to operate at the second faster speed after shut off of the motor, and including means for sensing that the bottom of the pool has been reached, and thereafter, the logic means returning the vehicle to the first primary speed.

5. The pool cleaning vehicle as set forth in claim 3, wherein the vehicle moves along the surface of the pool at the primary speed, shuts off and upon re-activation by the logic means, while the vehicle is descending the pool wall, the logic means sends a signal to the vehicle to operate at the faster descent speed for a pre-determined time; after a pre-determined period of time, the logic means sends a signal to the pump motor to return to the primary speed.

6. The pool cleaning vehicle as set forth in claim 1, wherein the vehicle releases air through the outlet after shut off of the pump motor.

7. A pool cleaning vehicle having drive means for moving the vehicle about a surface of a pool, the vehicle including a filtration system having a pump motor of a pump for pumping pool water through the vehicle filtration system, the pump creating a suction force, the suction force being sufficient to allow the vehicle to climb pool walls, comprising:

a housing including:

a body shell and a frame, the shell being removably attached to the frame, the frame including a base and the shell including an outlet;

sensor means for determining when the vehicle breaks the surface of the water; and event driven logic means to determine, first when to initiate the drive means; second, to determine when the vehicle breaks the surface of the water; third, to shut off the pump motor and the drive means when the vehicle breaks the surface of the water; fourth, to re-activate the pump motor and the drive means after a predetermined time, wherein the drive means and the pump motor comprises a single electrical motor.

8. The pool cleaning vehicle as set forth in claim 7, wherein the vehicle releases air through the outlet after shut off of the pump motor.

9. A pool cleaning vehicle having drive means for moving the vehicle about a surface of a pool, the vehicle including a filtration system having a pump motor of a pump for pumping pool water through the vehicle filtration system, the pump creating a suction force, the suction force being sufficient to allow the vehicle to climb pool walls, comprising:

a housing including:

a body shell and a frame, the shell being removably attached to the frame, the frame including a base and the shell including an outlet;

sensor means for determining when the vehicle is climbing a wall one of the pool walls; and time driven logic means, initiating shut off of the pump motor after a pre-determined time when vehicle begins climbing one of the pool walls; and re-starting the pump motor in a pre-determined time after shut off, wherein the drive means and pump motor comprises a single electrical motor.

10. The pool cleaning vehicle as set forth in claim 9 wherein the vehicle releases air through the outlet after shut off of the pump motor.

11. A pool cleaning vehicle having drive means for moving the vehicle about a surface of a pool, the vehicle including a filtration system having a pump motor for pumping pool water through the vehicle filtration system, the pump motor creating a suction force, the suction force being sufficient to allow the vehicle to climb the pool walls, and the vehicle including logic means, the logic means for executing logic, the logic comprising the steps of:

initiating the drive means for movement along the surface of the pool;

moving the vehicle until contact with the wall is sensed by a sensor;

timing vehicle movement, if no wall is sensed within a first predetermined period of time, vehicle direction is reversed;

upon sensing a wall, timing the movement for a second predetermined period of time;

after reaching the second predetermined period of time, shutting off the drive means and the pump motor for a third predetermined period of time;

after reaching the third pre-determined time for shut off, re-starting the pump motor; and repeating the above pattern, wherein the pump motor operates at a second faster speed until a predetermined distance from the surface of the pool is reached and thereafter returning the pump motor to a slower first speed.

12. The pool cleaning vehicle as set forth in claim 11, wherein the first predetermined period of time is between 30 and 120 seconds.

13. The pool cleaning vehicle as set forth in claim 11, wherein the second predetermined period is between 3 and 20 seconds.

14. The pool cleaning vehicle as set forth in claim 11, wherein the third predetermined period of time is between 0.2 and 5 seconds.

15. A pool cleaning vehicle having drive means for moving the vehicle about a surface of a pool, the vehicle including a first sensor for sensing an encounter with a pool wall, a second sensor for sensing the distance between a water surface of the pool and the vehicle and a third sensor for sensing a predetermined vehicle travel distance, the vehicle including a filtration system having a pump motor for pumping pool water through the vehicle filtration system, the pump motor creating a suction force, the suction force being sufficient to allow the vehicle to climb the pool walls, and the pump motor serving as a motor for the drive means and the vehicle including logic means, the logic means causing the pool cleaning vehicle to perform the steps of:

initiating the drive means for movement along the surface of the pool;

moving the vehicle until contact with a wall is sensed by a sensor;

or, in the alternative after going a predetermined travel distance, reversing the direction of the vehicle;

upon sensing a wall, activating a new travel distance sensor and causing the vehicle to travel a second predetermined distance;

after reaching the second predetermined distance, shutting off the pump motor and drive means and activating the sensor for sensing the distance from the surface of the water;

upon receiving a predetermined distance from the surface of the water, re-activing the pump motor;

after reaching the third pre-determined time for shut off, re-starting the pump motor; and repeating the above pattern, wherein the vehicle releases air through the outlet after shut off of the pump motor.

16. The pool cleaning vehicle as set forth in claim 15, wherein the pump motor includes a two speed motor, and whereupon reactivating the motor, the motor operates at a second speed faster than the first speed.

* * * * *